US011369156B2

(12) United States Patent
Huling

(10) Patent No.: US 11,369,156 B2
(45) Date of Patent: Jun. 28, 2022

(54) GARMENT WITH POCKET ACCESSIBLE FOR A PERSON ALONGSIDE A WEARER OF THE GARMENT

(71) Applicant: Jeffery D. Huling, Denver, CO (US)

(72) Inventor: Jeffery D. Huling, Denver, CO (US)

( * ) Notice: Subject to any disclaimer, the term of this patent is extended or adjusted under 35 U.S.C. 154(b) by 45 days.

(21) Appl. No.: 16/681,659

(22) Filed: Nov. 12, 2019

(65) Prior Publication Data

US 2021/0137190 A1 May 13, 2021

(51) Int. Cl.
*A41D 27/20* (2006.01)
*A41D 3/00* (2006.01)

(52) U.S. Cl.
CPC ..... *A41D 27/20* (2013.01); *A41D 3/00* (2013.01)

(58) Field of Classification Search
CPC ..... A41D 27/20; A41D 3/00
USPC ..... 2/247
See application file for complete search history.

(56) References Cited

U.S. PATENT DOCUMENTS 1,905,235 A * 4/1933 Mandelert ..... A41D 27/20 2/94
4,123,804 A 11/1978 Michael et al.
4,275,468 A * 6/1981 Outlaw ..... A41D 27/20 2/115
5,038,779 A 8/1991 Barry et al.
5,088,116 A 2/1992 Gould
5,173,968 A 12/1992 Fox
5,826,273 A 10/1998 Eckes
5,845,336 A 12/1998 Golde
5,953,757 A 9/1999 Blanks, I
5,953,758 A 9/1999 Foster
7,171,695 B2 2/2007 Braun
7,739,748 B2 6/2010 Nilforushan et al.
7,966,667 B2 6/2011 Tomlinson et al.
8,434,163 B1 5/2013 Nudo
8,876,875 B1 11/2014 Nilforushan et al.
D739,086 S 9/2015 Grove
9,456,639 B2 * 10/2016 Aylward ..... A41D 27/20
10,362,819 B2 * 7/2019 Staub ..... A41D 27/24
10,918,148 B2 * 2/2021 Brandt ..... A41D 27/20
2005/0235398 A1 * 10/2005 Yoo ..... A41D 27/208 2/247
2008/0125842 A1 5/2008 Petitt
2016/0174628 A1 * 6/2016 Tuffery ..... A41D 13/0575 2/93
2016/0206017 A1 * 7/2016 Aylward ..... A41D 1/22
2017/0172239 A1 * 6/2017 Staub ..... A41D 27/24
(Continued)

FOREIGN PATENT DOCUMENTS

WO WO-2012115368 A2 * 8/2012 ..... A41D 27/20

*Primary Examiner* — Tajash D Patel
(74) *Attorney, Agent, or Firm* — Kolisch Hartwell, P.C.

(57) ABSTRACT

An upper garment is provided for use by both a wearer and a person positioned alongside the wearer. The upper garment may include first and second sleeves with a first pocket located in the first sleeve above the elbow in a rear portion. The first pocket may include an opening and an internal space having a depth dimension and a width dimension, wherein the depth dimension extends in a direction away from the opening toward an inner portion of the first sleeve. The internal space may be sized and the opening and the depth dimension may be configured to receive within the internal space the hand of the person positioned alongside the wearer.

20 Claims, 4 Drawing Sheets

(56) References Cited

U.S. PATENT DOCUMENTS

2018/0160751 A1* 6/2018 Epp Frenette ..... A45F 5/02
2018/0343942 A1* 12/2018 Brandt ..... A41D 27/20

* cited by examiner

GARMENT WITH POCKET ACCESSIBLE FOR A PERSON ALONGSIDE A WEARER OF THE GARMENT

FIELD OF THE DISCLOSURE

The field of the present disclosure includes garments for wearing by one person providing pockets for use by another person. More specifically, the field of the present disclosure is directed to an upper garment with one or more pockets accessible by a person standing and walking alongside the wearer of the garment.

BACKGROUND OF THE DISCLOSURE

Prior apparel have provided pockets, vents, and other openings in an outer surface of the apparel located in a variety of locations and orientations. Generally, such openings are located and oriented to provide access by a hand of the wearer of the apparel. Such openings, whether located on a front, side, or back portion of the apparel are typically oriented for convenient access by one or both of the wearer's hand(s). An exception to this is prior apparel providing for storage of thermal packs or for display of a license. Examples of these are seen in U.S. Pat. Nos. 5,038,779, 5,173,968, 5,826,273, 7,739,748, 8,434,163, and 8,876,875, which provide openings that are not convenient for access by either the wearer or a person positioned alongside the wearer.

U.S. Pat. No. 4,123,804 addresses the potential for a person walking alongside a wearer of a garment to access an opening on the garment, but provides structure on such garment with only limited functionality for such potential. For example, U.S. Pat. No. 4,123,804 provides a glove or mitten sewn on to an exterior of a pair of pants (FIGS. 1, 3-6, and 8). U.S. Pat. No. 4,123,804 also discloses pockets in an upper garment (FIGS. 2 and 7) but not in a location and orientation for convenient access by a person standing alongside the wearer. That is, the sewn-on half glove 20 of FIG. 2 of U.S. Pat. No. 4,123,804, is not in a convenient location for access by a person alongside the wearer, but rather appears to be for a person in front of the wearer with an arm reaching around to the wearer's back. Similarly, the internal mitten 52 of FIG. 7 of U.S. Pat. No. 4,123,804 is not conveniently accessible by a person alongside the wearer but rather a person standing directly behind the wearer. Similar to the mitten 52 of FIG. 7 of U.S. Pat. No. 4,123,804, another U.S. Pat. No. 7,966,667 provides an upper garment with pockets on a front portion that are located and oriented for access by a person standing directly behind the wearer.

The prior art fails to optimize the potential for an upper garment to allow for a person, walking or standing side-by-side with the wearer of the garment, to place a hand in a pocket of the garment in a natural and comfortable manner that promotes the affection shared by the person and the wearer denoted by such action. Pockets located and oriented in such manner are described below.

SUMMARY OF THE DISCLOSURE

The subject matter disclosed herein relates to pockets located and oriented in an upper garment to be accessible to a hand of a person alongside a wearer of the garment. One exemplary embodiment provides for an upper garment for use by both the wearer and the person positioned alongside the wearer. In such embodiment the upper garment may include a main body providing a trunk opening, a neck opening, and two arm openings. The main body may include a chest portion and a back portion, and the back portion may define a vertical centerline. A first pocket may be located in the back portion of the main body. The first pocket may include a substantially vertical opening and an internal space having a depth dimension and a width dimension. The depth dimension of the pocket may extend in a direction away from the vertical centerline. The internal space of the pocket may be sized, and the opening and the depth dimension may be configured, to receive within the internal space the hand of the person positioned alongside the wearer when the wearer wears the garment and the person reaches across the vertical centerline of the back portion of the garment to insert the hand through the opening and into the first pocket.

The back portion of the garment may define a horizontal midline perpendicular to the vertical centerline so that the back portion defines an upper left quadrant above the midline and left of the centerline, an upper right quadrant above the midline and right of the centerline, a lower left quadrant below the midline and left of the centerline, and a lower right quadrant below the midline and right of the centerline. The pocket configured to receive the hand of the person positioned alongside the wearer may be located in one of the lower quadrants. The garment may include a second pocket located in the other one of the lower quadrants, which may be configured for access by the person standing alongside the wearer of the garment on a side opposite the side for access to the first pocket.

The garment may be configured to have the depth dimension of the first pocket extend substantially horizontally. The opening of the first pocket may be positioned to one side of the vertical centerline of the garment and the depth dimension of the pocket may extend away from the vertical centerline of the garment.

The garment may include the second pocket located on the back portion of the garment and the two pockets may be located on different sides of the vertical centerline of the back portion of the garment. One of the pockets may be accessible to the person when standing to the left of the wearer and the other pocket may be accessible to the person when standing to the right of the wearer. The opening of one or both of the pockets may be selectively closable.

The upper garment may include one or two sleeves and another pocket may be located on one of the sleeves, which pocket may be configured to receive the hand of the person positioned alongside the wearer. Another pocket may be located on the other sleeve and similarly configured for use by the person when on that side of the wearer.

Another embodiment of the invention may include a pocket in a back portion or in an arm of an upper garment, in either case accessible to a person standing alongside a wearer of the garment. The upper garment may be for use by both a wearer and a person positioned alongside the wearer. The upper garment may include a main body providing a trunk opening, a neck opening, and two arm openings. The main body may include a chest portion and a back portion. The upper garment may include a first sleeve and a second sleeve, each sleeve extending from one of the arm openings of the main body. The garment may include a first pocket located in a selected one of the first sleeve, the second sleeve, or the back portion of the main body. The first pocket may include an opening and an internal space having a depth dimension and a width dimension. The depth dimension of the first pocket may extend in a direction away from the opening. The internal space of the first pocket may be sized and the opening and the depth dimension may be configured to receive within the internal space the hand of the person positioned alongside the wearer. The opening and the depth dimension of the first pocket may be configured to be substantially inaccessible to a hand of the wearer of the garment without the wearer's either raising an arm or turning the hand so that the palm faces away from the body.

The upper garment may include second, third, and fourth pockets, each pocket having an internal space, an opening, and a depth dimension configured to receive within the internal space the hand of the person positioned alongside the wearer. The opening and the depth dimension of each pocket may be configured to be substantially inaccessible to the wearer of the garment.

The back portion of the upper garment may define a vertical centerline and the first pocket may be located in the back portion to one side of the vertical centerline. The depth dimension of the first pocket may extend away from the vertical centerline. The internal space of the first pocket located in the back portion may be sized and the opening and the depth dimension may be configured to receive the hand of the person positioned alongside the wearer when the wearer wears the garment and the person reaches across the vertical centerline of the back portion of the garment to insert the hand through the opening and into the first pocket. The upper garment may include a second pocket located on the back portion on the other side of the vertical centerline and wherein the first pocket is accessible by the person when standing to one side of the wearer and the second pocket is accessible by the person when standing to other side of the wearer.

The sleeves of the garment may define a rear portion and an inner portion. The first pocket may be located on one of the sleeves. The opening of the first pocket may be located on the rear portion of one of the sleeves and the depth dimension may extend from the opening toward the inner portion of the sleeve. The upper garment may include a second pocket located on the other sleeve. The opening of the second pocket may be located on the rear portion of the other sleeve and the depth dimension may extend from the opening toward the inner portion of the other sleeve.

The opening of the first pocket may include a closure mechanism. The internal space of the first pocket may be defined by an enclosed lining.

In another embodiment, an upper garment may include a pair of pockets on a back portion of the garment. An upper garment may be for use by both a wearer and a person positioned alongside the wearer on either side of the wearer, the person having a pair of hands. The upper garment may include a main body providing a trunk opening, a neck opening, and two arm openings. The main body may include a chest portion and a back portion. The back portion of the main body may define a vertical centerline. The garment may include a first pocket and a second pocket and each pocket may be located in the back portion of the main body. Each pocket may include a substantially vertical opening and an internal space having a depth dimension and a width dimension. The first pocket may be located to one side of the vertical centerline and the depth dimension of the first pocket may extend in a direction away from the vertical centerline. The second pocket may be located on the other side of the vertical centerline and the depth dimension of the first pocket may extend in a direction away from the vertical centerline. The internal space of each pocket may be sized and the opening and the depth dimension of each pocket may be configured to receive within the internal space one of the hands of the person positioned alongside the wearer when the wearer wears the garment and the person reaches across the vertical centerline of the back portion of the garment to insert the hand through the opening and into one of the pockets.

Another embodiment may provide an upper garment with a pair of pockets on the sleeves. An upper garment may be for use by both a wearer and a person positioned alongside the wearer on either side of the wearer. The upper garment may include a main body providing a trunk opening, a neck opening, and two arm openings. The main body may include a chest portion and a back portion. The garment may include a first sleeve and a second sleeve, each sleeve extending from one of the arm openings of the main body. Each of the sleeves may define a rear portion and an inner portion. The garment may include a first pocket located in the first sleeve. The first pocket may include an opening and an internal space having a depth dimension and a width dimension. The opening of the first pocket may be located on the rear portion of the first sleeve and the depth dimension may extend away from the opening toward the inner portion of the first sleeve. The internal space of the first pocket may be sized and the opening and the depth dimension of the first pocket may be configured to receive within the internal space the hand of the person positioned alongside the wearer. The garment may include a second pocket located in the second sleeve. The second pocket may include an opening and an internal space having a depth dimension and a width dimension. The opening of the second pocket may be located on the rear portion of the second sleeve and the depth dimension may extend away from the opening toward the inner portion of the second sleeve. The internal space of the second pocket may be sized and the opening and the depth dimension of the second pocket may be configured to receive within the internal space the hand of the person positioned alongside the wearer.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION OF THE DISCLOSURE

Figure 2:
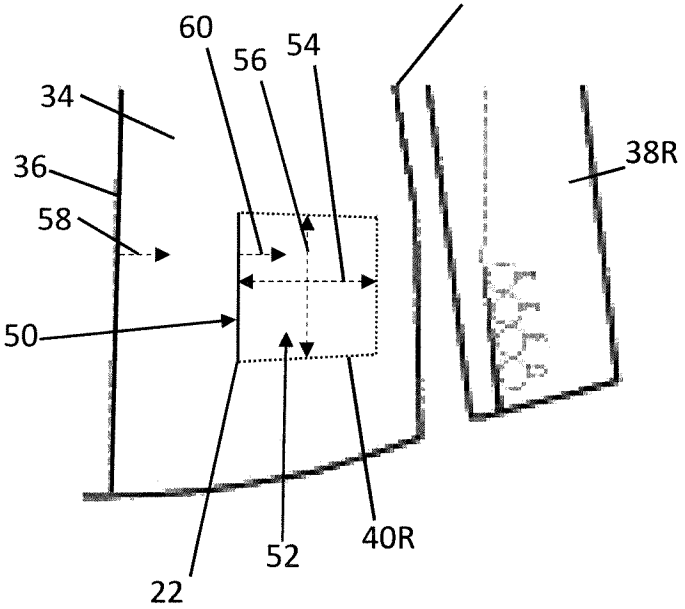
FIG. 2 depicts a close-up view of a representative one of the pockets, this one on the lower back portion of the jacket, illustrating the direction of the pocket relative to its opening and the depth and width dimensions of the pocket.

As shown in FIGS. 1-8, an upper garment, such as a jacket 20, may be worn by a wearer W and include pockets 22 that are accessible to a hand H of a person P who is alongside the wearer of the garment, for example standing, walking, or sitting alongside the wearer, typically with both the wearer and the person facing in the same direction. The present disclosure includes several exemplary embodiments of upper garment 20 that may be used by both the wearer and the person positioned alongside the wearer. In one embodiment the upper garment may include a main body 24 providing a trunk opening 26, a neck opening 28, and two arm openings 30. The main body may include a chest portion 32 and a back portion 34. Back portion 34 may define a vertical centerline 36. Sleeves 38L, 38R may be provided on left and right sides of jacket 20, each sleeve extending from one of arm openings 30 of main body 24.

Pockets 22 may be provided singly or in pairs with one of each pair accessible by person P when positioned to the right of wearer W and the other of each pair accessible by person P when positioned to the left of wearer W. For example, a pair of pockets 40L and 40R may be located on back portion 34, with one to the left of vertical centerline 36 and the other to the right of vertical centerline 36, which may also be a seam of jacket 20. A pair of pockets 42L and 42R may be provided in the left and right sleeves 38. A pair of pockets 46L and 46R may be provided in left and right shoulder areas 48L, 48R.

Each pocket 22 preferably includes an opening 50 and an internal space 52, which typically extends away from the opening and may be generally parallel to the outer surface of the jacket. Pockets 22 are depicted as internal to the jacket, with the internal space of the pocket below or within the surface of the jacket. Alternatively, the pockets may be sewn onto the exterior surface of the jacket.

FIG. 2 depicts pocket 40R in a lower right back portion of jacket 22, which has features exemplary of other pockets 22, including that internal space 52 has a depth dimension 54 and a width dimension 56, and that internal space 52 is sized to receive hand H of person P. Also, opening 50 is sized and oriented on jacket 22, and internal space 52 is also oriented, for access by hand H when person P is positioned alongside wearer W of jacket 20.

Pocket 40R, as one example, may include a substantially vertical opening 50, and internal space 52 may include depth dimension 54 that extends in a direction 58 roughly perpendicularly away from vertical centerline 36. Depth dimension 54 for any of pockets 22 may extend in a direction 60 that is roughly perpendicularly away from opening 50. Direction 60 may be selected and adjusted for each pocket 22 as best suited to the accessibility of hand H for the particular pocket on a particular design of jacket 20. See FIGS. 6-8 for exemplary manners in which person P may insert hand H in pockets 22.

Internal space 52 of pocket 22 may be sized, and opening 50 and depth dimension 54 and width dimension 56 may be configured, to receive within internal space 52 hand H of person P when person P is positioned alongside wearer W of jacket 20. Person P may reach, in the case of pockets 40L and 40R, across vertical centerline 36 of back portion 34 of jacket 20 to insert hand H through opening 50 and into either pocket, depending on which side of wearer W that person P is positioned.

Back portion 34 of jacket 20 may define a horizontal midline 62 substantially perpendicular to vertical centerline 36. Horizontal midline 62 and vertical centerline 36 may divide back portion into an upper left quadrant 64 above the midline and left of the centerline, an upper right quadrant 66 above the midline and right of the centerline, a lower left quadrant 68 below the midline and left of the centerline, and a lower right quadrant 70 below the midline and right of the centerline. Pockets 40L, 40R configured to receive hand H of person P positioned alongside wearer W may be located in lower left quadrant 68 and lower right quadrant 70, respectively, on different sides of vertical centerline 36. Pocket 40L may be configured for access by person P from the right of wearer W and pocket 40R may be configured for access by person P from the left of wearer W. Jacket 20 may be configured to have depth dimensions 54 of pockets 40L, 40R extend substantially horizontally.

Figure 1:
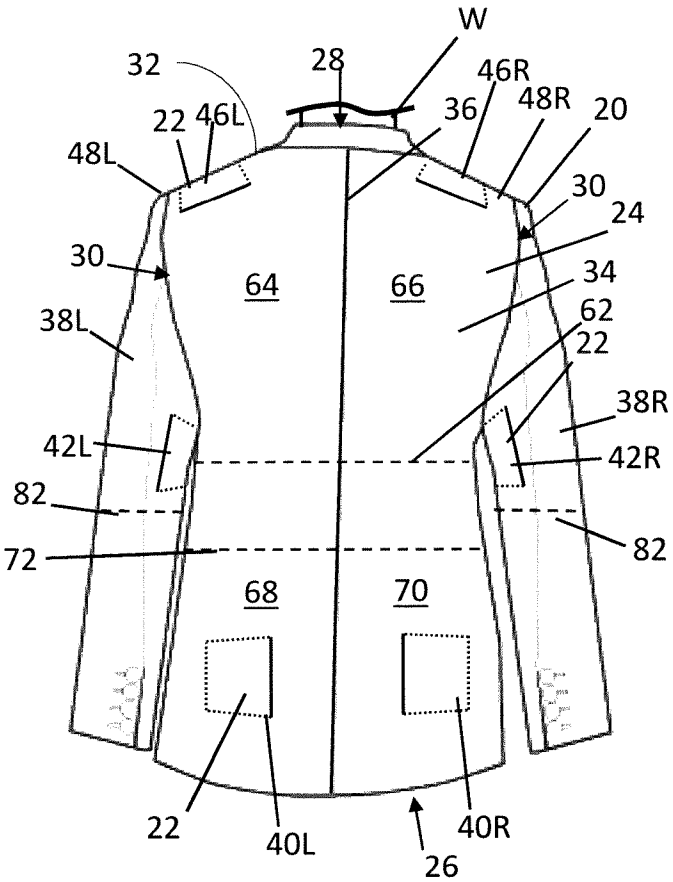
FIG. 1 depicts a view of a back portion of a jacket showing openings for pockets located on a lower back portion, an upper back/shoulder portion, and on both sleeves of the jacket.
Figure 4:
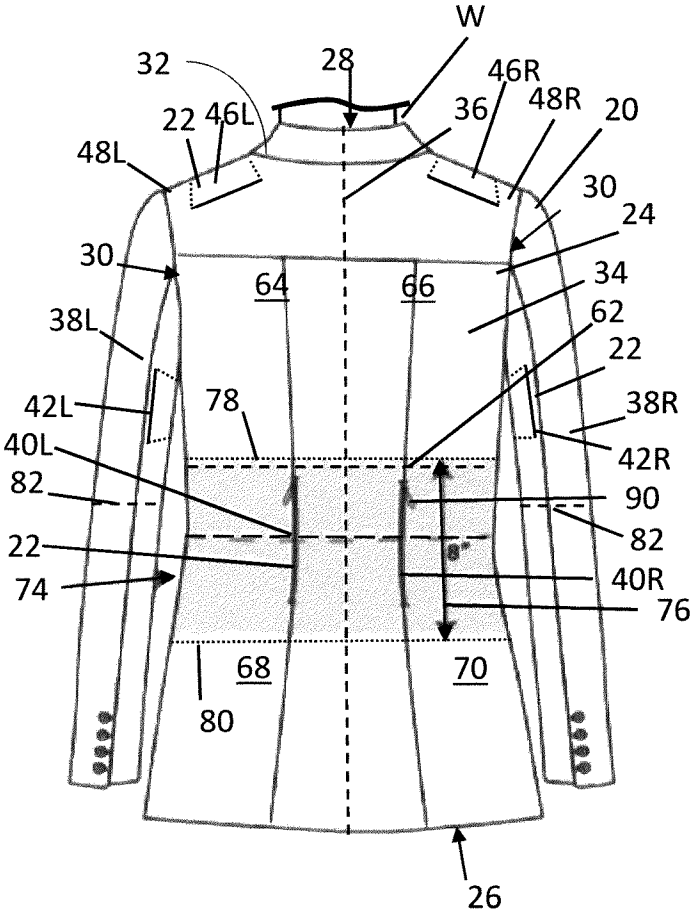
FIG. 4 depicts a view of a back portion of a jacket with a different cut than that shown in FIGS. 1 and 2, in this case with a more defined waist and with pockets located on the waist level.
Figure 3:
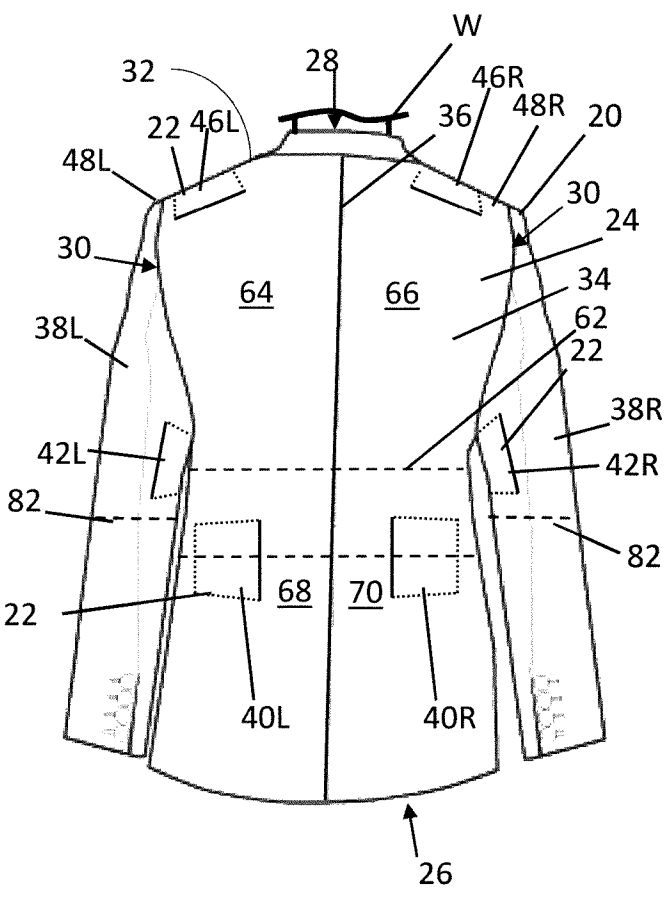
FIG. 3 depicts a view of a back portion of a jacket showing openings for pockets similar to FIG. 1, in this case with the pockets located on the lower back portion positioned at a higher level than those in FIG. 1.

As depicted in FIGS. 1-4, pockets 40L and 40R may be located in different areas, preferably in the lower back quadrants of jacket 20. In FIG. 1, pockets 40L, 40R are in a lower portion of the lower back quadrants below a waistline 72 of the jacket. In FIGS. 3 and 4, pockets 40L and 40R are roughly centered on waistline 72. Typically, the left and right pockets of each pair of pockets 22 are positioned the same vertically and horizontally on the jacket for a uniform appearance and alternatively may be differently disposed as suited to a particular jacket configuration. Pockets 40L and 40R preferably are located within a waist area 74, as illustrated in FIG. 4, which may be a band 76 several inches in height, for example about 8-inches, roughly centered on the waistline. Generally, waist area 74 has an upper edge 78 that roughly coincides with the horizontal midline 62 of the jacket and a lower edge 80 below waistline 72 in lower back quadrants 68, 70 of jacket 22.

Sleeves 38L and 38R may be of a long-sleeve or a short-sleeve configuration. In a long-sleeve configuration, sleeves 38L, 38R may define an elbow level 82. Pockets 42L, 42R may be located above elbow level 82. Pockets 42L, 42R may be configured to receive hand H of person positioned alongside the wearer. Another pocket may be located on the other sleeve and similarly configured for use by the person when on that side of the wearer.

Figure 5:
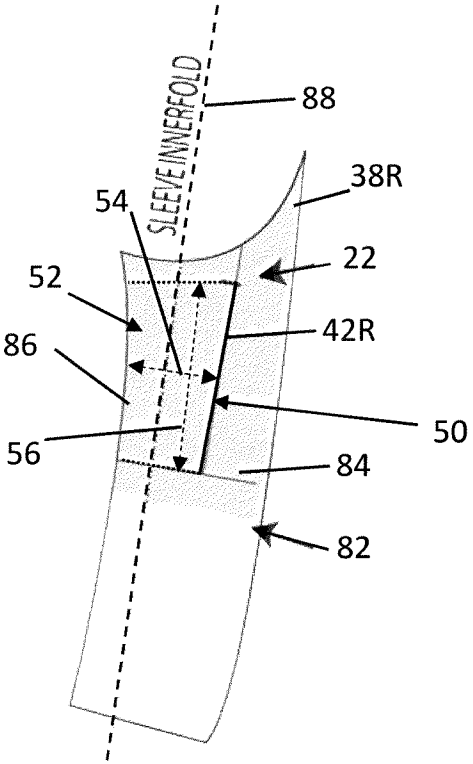
FIG. 5 depicts a sleeve of a jacket consistent with those shown in FIGS. 1-4, the sleeve viewed from an inner side, that is outwardly from the body of the jacket, and depicting an opening for a pocket on the sleeve.

As best seen in FIG. 5, each sleeve 38 defines a rear portion 84 and an inner portion 86, and typically inner portion 86 is across a sleeve inner fold 88. Each sleeve pocket, such as right pocket 42R, is typically located in the sleeve and includes opening 50 and internal space 52 having depth dimension 54 and width dimension 56. Opening 50 of pocket 42R may be located on rear portion 84 of sleeve 38R and depth dimension 54 may extend away from opening 50 toward inner portion 86 of sleeve 38R. Internal space 52 of pocket 42R may be sized, and opening 50 and depth dimension 54 of pocket 42R may be configured, to receive within internal space 52 hand H of person P positioned alongside wearer W. Jacket 20 may include second pocket 42L located in sleeve 38L. Pocket 42L may include opening 50 and internal space 52 having depth dimension 54 and width dimension 56. Opening 50 of second pocket 42L may located on rear portion 84 of sleeve 38L and depth dimension 54 may extend away from opening 50 toward inner portion 86 of sleeve 38L. Internal space 52 of pocket 42L may be sized, and opening 50 and depth dimension 54 of pocket 42L may be configured, to receive within internal space 52 hand H of person P positioned alongside wearer W.

One or more of pockets 22 may be selectively closable. For example, a closure mechanism 90, such as a zipper (e.g., FIG. 4) or one or more snaps or buttons may be provided at opening 50 of one or more of pockets 22. Other closure mechanisms may include hook-and-loop fasteners or magnets, or any other device as suited to a particular style of garment. Alternatively, one or more pockets may have no closure mechanism.

Typically all of the openings of all of pockets 22 are visible from the rear of the jacket while the jacket is worn. Each pocket may be provided with a hem and/or closures at the opening of a different color and/or pattern from the surrounding color and pattern of the jacket to make the opening more readily noticeable. Examples of more readily noticeable closure mechanisms include zippers with varying color or pattern on the pull tab, teeth, slider body, tape, bottom stop, insertion pin, and/or top stop.

Internal space 52 of one or more pockets 22 may be defined by an enclosed lining, which may be provided with a color, pattern, and texture corresponding to the exterior surface of the jacket, or one or more of the color, pattern, and/or texture may contrast with the exterior surface of the jacket. Examples of pocket liner materials that may be used include satin, silk, wool, velvet, and cotton. Alternatively, one or more pockets may include no internal lining.

Typically, opening 50 and depth dimension 54 of each pocket 22 is configured to be substantially inaccessible to a hand of wearer W of jacket 20 without the wearer's doing one or more of raising an upper arm from a natural rest position, turning the hand so that the palm faces away from the body, or moving jacket 22 from a natural position on the wearer's upper body.

Figure 6:
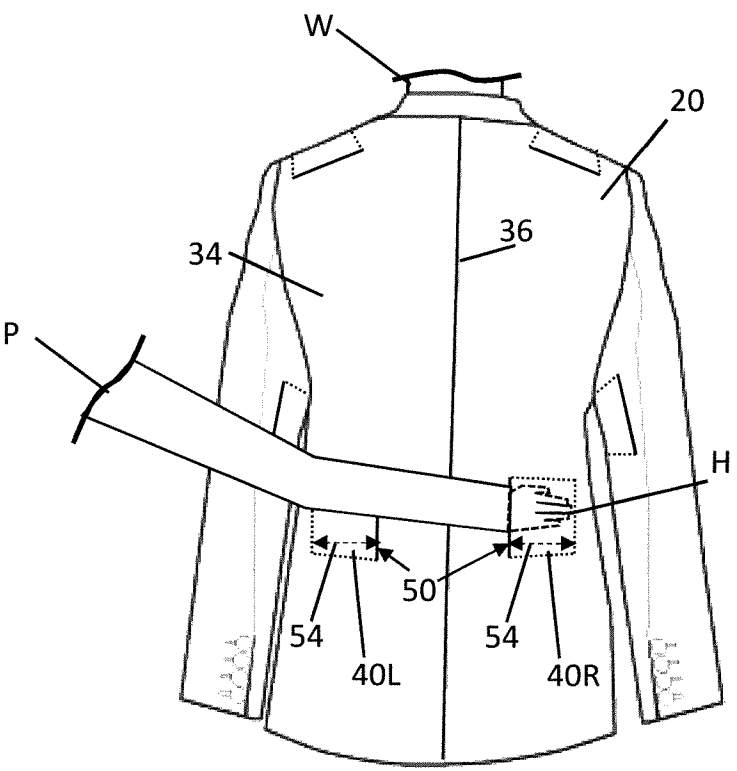
FIG. 6 depicts the jacket as in FIG. 3, and showing an arm of a person alongside a wearer of the jacket, extending around the jacket with a hand inside one of the pockets on the lower portion of the jacket.

As best seen in FIG. 6, internal space 52 of pocket 40R located in back portion 34 may be sized, and opening 50 and depth dimension 54, may be configured to receive hand H of person P positioned alongside wearer W when wearer W wears jacket 20 and person P, positioned alongside wearer W, reaches across vertical centerline 36 of back portion 34 of jacket 20 to insert hand H through opening 50 and into pocket 40R. Jacket 22 may also include a second pocket 40L located on back portion 34 on the other side of vertical centerline 36 and this configuration provides for first pocket 40R to be accessible by person P when standing to the left side of wearer W and for second pocket 40L to be accessible by person P when standing to the other side of wearer W.

Pockets 40L, 40R may be located anywhere in the lower back quadrants of the jacket. A typical area for pockets 40L, 40R is, with the jacket worn in normal fashion on wearer W, just above the gluteus maximus, with opening 50 of each pocket to the left and to the right of the lower lumbar vertebra and/or at least partially as low as the sacrum. Alternatively, the vertical position of the pockets may be within a range roughly corresponding to the upper and lower range of the external oblique muscles.

Figure 7:
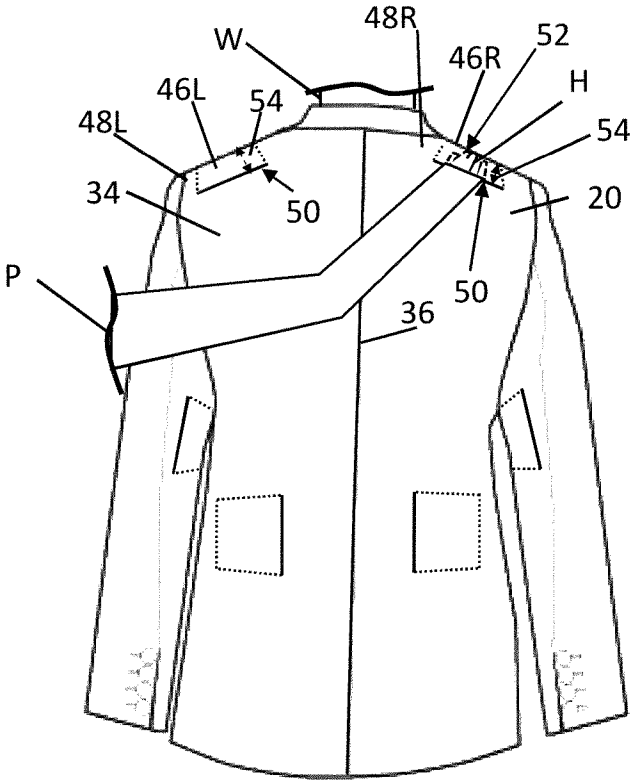
FIG. 7 depicts the jacket as in FIG. 3, and showing an arm of a person alongside a wearer of the jacket, extending around the jacket with a hand inside one of the pockets on the shoulder portion of the jacket.

As best seen in FIG. 7, internal space 52 of pocket 46R located in shoulder area 48R may be sized, and opening 50 and depth dimension 54 may be configured, to receive hand H of person P positioned alongside wearer W when wearer W wears jacket 20 and person P, positioned alongside wearer W, reaches across vertical centerline 36 to shoulder area 48R of jacket 20 to insert hand H through opening 50 and into pocket 46R. Jacket 22 may also include a second pocket 46L located in shoulder area 48L on the other side of vertical centerline 36 and this configuration provides for first pocket 46R to be accessible by person P when standing to the left side of wearer W and for second pocket 46L to be accessible by person P when standing to the other side of wearer W.

Pockets 46L, 46R may be positioned in any location and orientation in shoulder areas 48L, 48R as suited for use by person P alongside wearer W. Openings 50 of pockets 46L, 46R may, for example, be rotated towards a more vertical orientation and/or moved outward on shoulders 48L, 48R as compared to that shown in FIG. 7.

Figure 8:
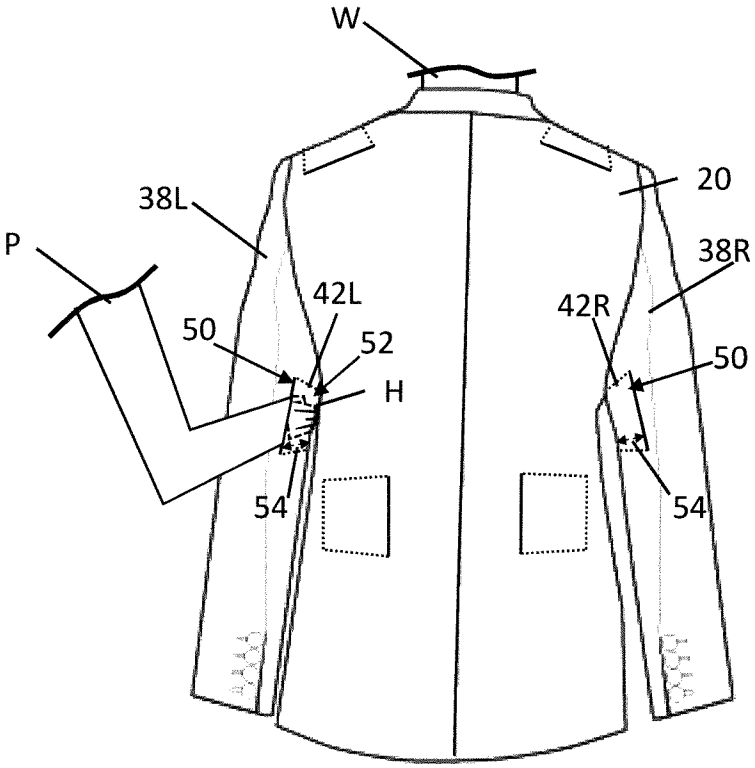
FIG. 8 depicts the jacket as in FIG. 3, and showing an arm of a person alongside a wearer of the jacket, with a hand inside one of the pockets on the sleeve of the jacket.

As best seen in FIG. 8, internal space 52 of pocket 42L located on sleeve 38L may be sized, and opening 50 and depth dimension 54 may be configured, to receive hand H of person P positioned alongside wearer W when wearer W wears jacket 20 and person P, positioned alongside wearer W, reaches to sleeve 38L of jacket 20 to insert hand H through opening 50 and into pocket 42L. Jacket 22 may also include a second pocket 42R located on sleeve 38R and this configuration provides for first pocket 42L to be accessible by person P when standing to the left side of wearer W and for second pocket 42R to be accessible by person P when standing to the other side of wearer W.

Pockets 42L, 42R may be positioned in any location and orientation in sleeves 38L, 38R as suited for use by person P alongside wearer W. Openings 50 of pockets 42L, 42R may, for example, be altered in orientation and/or shifted around sleeves 38L, 38R toward the sleeve innerfold or the sleeve outerfold as compared to that shown in FIG. 8.

As used herein, the word "exemplary" means "serving as an example, instance, or illustration." Any embodiment described herein as "exemplary" is not to be construed as necessarily preferred or advantageous over other embodiments. Additionally, it will be appreciated that for simplicity and/or clarity of illustration, elements illustrated in the figures have not necessarily been drawn to scale. For example, the dimensions of some of the elements may be exaggerated relative to other elements for illustrative clarity. Further, in some figures only one or two of a plurality of similar elements are indicated by reference characters for illustrative clarity of the figure, whereas less than all of the similar elements may be indicated by reference characters. Further still, it should be understood that although some portions of components and/or elements of the subject matter disclosed herein have been omitted from the figures for illustrative clarity, good design, material selection, and assembly practices are intended.

I claim:

1. An upper garment for use by both a wearer and a person positioned alongside the wearer, the upper garment comprising:

a main body providing a trunk opening, a neck opening, and two arm openings, the main body including a chest portion and a back portion, a first sleeve and a second sleeve, each sleeve extending from one of the arm openings of the main body, wherein each of the sleeves of the garment defines an elbow level, a rear portion, and an inner portion, and a first pocket located in the first sleeve and wherein the first pocket includes an opening and an internal space having a depth dimension and a width dimension, wherein the depth dimension extends in a direction away from the opening, and wherein the opening of the first pocket is located on the rear portion of the first sleeve above the elbow level and the depth dimension extends from the opening toward the inner portion of the first sleeve, and wherein the internal space is sized and the opening and the depth dimension are configured to receive within the internal space the hand of the person positioned alongside the wearer, and wherein the first pocket is internal to the upper garment and wherein the internal space of the first pocket is defined by an enclosed lining.

2. The upper garment according to claim 1 wherein the upper garment further comprises a second pocket located on the second sleeve above the elbow level and wherein the second pocket includes an opening and an internal space having a depth dimension and a width dimension, wherein the depth dimension extends in a direction away from the opening, and wherein the second pocket is internal to the upper garment and wherein the internal space of the second pocket is defined by an enclosed lining.

3. The upper garment according to claim 2 wherein the opening of the second pocket is located on the rear portion of the second sleeve and the depth dimension extends from the opening toward the inner portion of the second sleeve.

4. The upper garment according to claim 1 further comprising second, third, and fourth pockets, wherein each pocket is internal to the upper garment, and each pocket having an internal space defined by an enclosed lining, an opening, and a depth dimension configured to receive within the internal space the hand of the person positioned alongside the wearer.

5. The upper garment of claim 4 wherein the back portion defines a vertical centerline and wherein the third pocket is located in the back portion to one side of the vertical centerline and the depth dimension of the third pocket extends away from the vertical centerline.

6. The upper garment of claim 5 wherein the internal space of the third pocket is sized and the opening and the depth dimension are configured to receive the hand of the person positioned alongside the wearer when the wearer wears the garment and the person reaches across the vertical centerline of the back portion of the garment to insert the hand through the opening and into the third pocket.

7. The upper garment according to claim 6, wherein the fourth pocket is located on the back portion on the other side of the vertical centerline from the third pocket and wherein the third pocket is accessible by the person when standing to one side of the wearer and the fourth pocket is accessible by the person when standing to the other side of the wearer.

8. The upper garment of claim 1 wherein the opening of the first pocket includes a closure mechanism.

9. The upper garment of claim 1 further comprising second, third, and fourth pockets, wherein each pocket is internal to the upper garment, and each pocket having an internal space defined by an enclosed lining, an opening, and a depth dimension and a width dimension configured to receive within the internal space the hand of the person positioned alongside the wearer, and wherein each opening of each of the pockets includes a closure mechanism.

10. An upper garment for use by both a wearer and a person positioned alongside the wearer, the person having a hand, the upper garment comprising:

a main body providing a trunk opening, a neck opening, and two arm openings, the main body including a chest portion and a back portion, wherein the back portion defines a vertical centerline; and the garment further including a first sleeve and a second sleeve, each sleeve extending from one of the arm openings of the main body, wherein each of the sleeves of the garment defines an elbow level, a rear portion, and an inner portion, a first pocket located in the first sleeve and wherein the first pocket includes an opening and an internal space having a depth dimension and a width dimension, wherein the depth dimension extends in a direction away from the opening, and wherein the opening of the first pocket is located on the rear portion above the elbow level of the first sleeve and the depth dimension extends from the opening toward the inner portion of the first sleeve, and wherein the internal space is sized and the opening and the depth dimension are configured to receive within the internal space the hand of the person positioned alongside the wearer, and wherein the first pocket is internal to the upper garment and wherein the internal space of the first pocket is defined by an enclosed lining; and and a second pocket located in the back portion of the main body, wherein the second pocket includes a substantially vertical opening and an internal space having a depth dimension and a width dimension, wherein the depth dimension extends in a direction away from the vertical centerline, and wherein the internal space is sized and the opening and the depth dimension are configured to receive within the internal space the hand of the person positioned alongside the wearer when the wearer wears the garment and the person reaches across the vertical centerline of the back portion of the garment to insert the hand through the opening and into the first pocket.

11. The upper garment according to claim 10, wherein the back portion defines a horizontal midline perpendicular to the vertical centerline, and further wherein the back portion defines an upper left quadrant above the midline and left of the centerline, an upper right quadrant above the midline and right of the centerline, a lower left quadrant below the midline and left of the centerline, and a lower right quadrant below the midline and right of the centerline, and further wherein the second pocket is located in one of the lower quadrants.

12. The upper garment of claim 11 further comprising a third pocket located in the other one of the lower quadrants.

13. The upper garment of claim 11 wherein the depth dimension of the second pocket extends substantially horizontally.

14. The upper garment of claim 11 wherein the opening of the second pocket is positioned to one side of the vertical centerline of the garment and the depth dimension of the pocket extends away from the vertical centerline of the garment.

15. The upper garment of claim 10 further comprising a third pocket located on the back portion of the garment, wherein the second and third pockets are located on different sides of the vertical centerline of the back portion of the garment, and further wherein one of the pockets is accessible to the person when standing to the left of the wearer and the other pocket is accessible to the person when standing to the right of the wearer.

16. The upper garment according to claim 10 wherein the depth dimension of the second pocket extends away from the vertical centerline of the back portion of the garment.

17. The upper garment according to claim 10 wherein the opening of the second pocket is selectively closable.

18. The upper garment according to claim 10 wherein a third pocket is located on the second sleeve and is configured to receive the hand of the person positioned alongside the wearer.

19. An upper garment for use by both a wearer and a person positioned alongside the wearer on either side of the wearer, the person having a hand, the upper garment comprising:

a main body providing a trunk opening, a neck opening, and two arm openings, the main body including a chest portion and a back portion, wherein the back portion defines a vertical centerline; and wherein the garment further includes a first sleeve and a second sleeve, each sleeve extending from one of the arm openings of the main body, wherein each of the sleeves of the garment defines an elbow level, a rear portion, and an inner portion, and a first pocket and a second pocket, each pocket located in a respective one of the sleeves, wherein each pocket includes a substantially vertical opening and an internal space having a depth dimension and a width dimension, wherein the depth dimension of each of the first and second pockets extends in a direction away from the opening, and wherein the opening of each pocket is located above the elbow level on the rear portion of the respective sleeve and the depth dimension extends from the opening toward the inner portion of the respective sleeve, and wherein each internal space is sized and the opening and the depth dimension of each pocket are configured to receive within the internal space the hand of the person positioned alongside the wearer, and wherein the internal space of the first pocket is defined by an enclosed lining; and a third pocket and a fourth pocket, wherein each of the third and fourth pockets is internal to the upper garment, and each of the third and fourth pockets having an internal space defined by an enclosed lining, an opening, and a depth dimension configured to receive within the internal space the hand of the person positioned alongside the wearer, and further wherein the third pocket is located to one side of the vertical centerline and the depth dimension of the third pocket extends in a direction away from the vertical centerline, and wherein the fourth pocket is located on the other side of the vertical centerline and the depth dimension of the fourth pocket extends in a direction away from the vertical centerline, and wherein the internal space of each of the third and fourth pockets is sized and the opening and the depth dimension of each of the third and fourth pockets are configured to receive within the internal space the hand of the person positioned alongside the wearer when the wearer wears the garment and the person reaches across the vertical centerline of the back portion of the garment to insert the hand through the opening and into one of the third and fourth pockets.

20. An upper garment for use by both a wearer and a person positioned alongside the wearer on either side of the wearer, the upper garment comprising:

a main body providing a trunk opening, a neck opening, and two arm openings, the main body including a chest portion and a back portion, a first sleeve and a second sleeve, each sleeve extending from one of the arm openings of the main body, wherein each of the sleeves defines an elbow level, a rear portion, and an inner portion, and a first pocket located in the first sleeve, the first pocket including an opening and an internal space having a depth dimension and a width dimension, wherein the opening of the first pocket is located above the elbow level on the rear portion of the first sleeve and the depth dimension extends away from the opening toward the inner portion of the first sleeve, and wherein the internal space of the first pocket is defined by an enclosed lining, and wherein the internal space of the first pocket is sized and the opening and the depth dimension are configured to receive within the internal space the hand of the person positioned alongside the wearer, and a second pocket located in the second sleeve, the second pocket including an opening and an internal space having a depth dimension and a width dimension, wherein the opening of the second pocket is located above the elbow level on the rear portion of the second sleeve and the depth dimension extends away from the opening toward the inner portion of the second sleeve, and wherein the internal space of the second pocket is defined by an enclosed lining, and wherein the internal space of the second pocket is sized and the opening and the depth dimension are configured to receive within the internal space the hand of the person positioned alongside the wearer.

* * * * *